United States Patent [19]

Ausnit et al.

[11] Patent Number: 4,694,959

[45] Date of Patent: Sep. 22, 1987

[54] MAINTAINING SINGLE LINK CHAIN BAGS AGAINST SKEWING

[75] Inventors: Steven Ausnit, New York; Per Bentsen, Suffern, both of N.Y.

[73] Assignee: Minigrip, Inc., Orangeburg, N.Y.

[21] Appl. No.: 823,640

[22] Filed: Jan. 29, 1986

[51] Int. Cl.[4] ..... B65D 33/16; B65B 27/08

[52] U.S. Cl. ..... 206/390; 53/118; 53/399; 53/430; 53/593; 383/37; 493/210; 493/381

[58] Field of Search ..... 53/116, 118, 430, 399, 53/587, 591, 593; 206/390, 555; 383/37; 493/233, 238, 198, 211, 381, 210; 242/D2, 56.8, 59

[56] References Cited

U.S. PATENT DOCUMENTS

| | | | |
|---|---|---|---|
| 4,416,376 | 11/1983 | Scheffers et al. | 206/554 |
| 4,489,901 | 12/1984 | Anderson | 242/D2 |
| 4,490,959 | 1/1985 | Lems | 53/459 |
| 4,497,159 | 2/1985 | Lancaster, III | 53/587 |
| 4,514,962 | 5/1985 | Ausnit | 53/457 |
| 4,528,794 | 7/1985 | Thierstein | 53/587 |
| 4,538,397 | 9/1985 | Boss | 53/430 |
| 4,569,083 | 2/1986 | Titchenal | 383/37 |
| 4,584,706 | 4/1986 | Ausnit | 383/37 |
| 4,607,476 | 8/1986 | Fulton, Jr. | 53/587 |

*Primary Examiner*—Robert L. Spruill
*Assistant Examiner*—Donald R. Studebaker
*Attorney, Agent, or Firm*—Hill, Van Santen, Steadman & Simpson

[57] ABSTRACT

Bags in a series have first and second end portions with the bags being separated from one another except for links that connect the first end portions of the bags into a continuous chain, which is wound upon itself on a storage reel. Such winding may be in a vertical spiral fashion, or it may be by engagement by a separable continuous strip, such as a ribbon tape across the second end portions of the bags as reeled upon a core, thereby maintaining the bags in the chain substantially free from skewing relative to one another. Method and apparatus for effecting the reeling of the bag chain are also disclosed.

23 Claims, 7 Drawing Figures

MAINTAINING SINGLE LINK CHAIN BAGS AGAINST SKEWING

BACKGROUND OF THE INVENTION

The present invention relates to the handling of single link chain bags, and is more particularly concerned with maintaining such bags against skewing while being handled, such as for storage and shipment from a place where the bags are made to a place where the bags are to be filled and separated from the chain.

Bags of the type being dealt with here are made from plastic film and closed or sealed at a bottom end and at opposite sides and provided with an openable top arranged to be closed by means of separable and reclosable fastener means, sometimes referred to as zipper, of the tongue and groove type. This may be extruded integrally with the web material or film of the bags or may be separately extruded and then secured to the bag material by heat or fusion sealing or adhesive, depending upon whether the materials of the bag and zipper are compatible or not.

In any event, for convenience in filling the bags in filling machines, the bags are desirably connected together in a chain fashion, that is, in side-by-side continuous series. By way of example, in U.S. Pat. No. 4,490,959 chain bags connected by links at the upper and lower end portions of the bags are fed to and filled in an automatic bag filling machine. In another example of bag filling machine as disclosed in U.S. Pat. No. 4,514,962, the chain bags are connected only by links at the top ends of the bags.

Unless the bag chains are fed to the filling machine in a continuous production line wherein the bag chain is fabricated and, without significant delay, run through a bag filling station, it is necessary to store and possibly ship or otherwise handle the bags in a storage mode. One manner of storing such bags is disclosed in U.S. Pat. No. 4,416,376, wherein the bags are packed in a generally fan fold boxed dispensing package.

On the other hand, it may be more convenient to feed the chain of bags to a filling machine from a more convenient storage mode, such as from a reel or roll. However, a problem that arises in reeling a single link bag chain is that the bags may tend to skew relative to one another and wrinkle and interfere with smooth winding of the bag chain on itself. The present invention solves that problem.

SUMMARY OF THE INVENTION

It is, accordingly, an important object of the present invention to provide for the convenient and efficient handling of a single link bag chain while maintaining the bags against skewing or otherwise distorting.

Another object of the invention is to provide a new and improved method of and means for maintaining single link chain bags against skewing or otherwise distorting when reeled into a storage roll.

According to principles of the invention, there is provided a series of bags having first and second end portions and separated from one another except at single links connecting the first end portions of the bags into a continuous chain, and means for supporting the chain reeled upon itself and the bags maintained substantially free from skewing relative to one another.

There is also provided a method of maintaining single link chain bags free from skewing relative to one another a storage mode, and apparatus for practicing the method.

BRIEF DESCRIPTION OF THE DRAWINGS

Other objects, features and advantages of the invention will be readily apparent from the following description of representative embodiments thereof, taken in conjunction with the accompanying drawing, although variations and modifications may be effected without departing from the spirit and scope of the novel concepts embodied in the disclosure, and in which.

Figure 1:
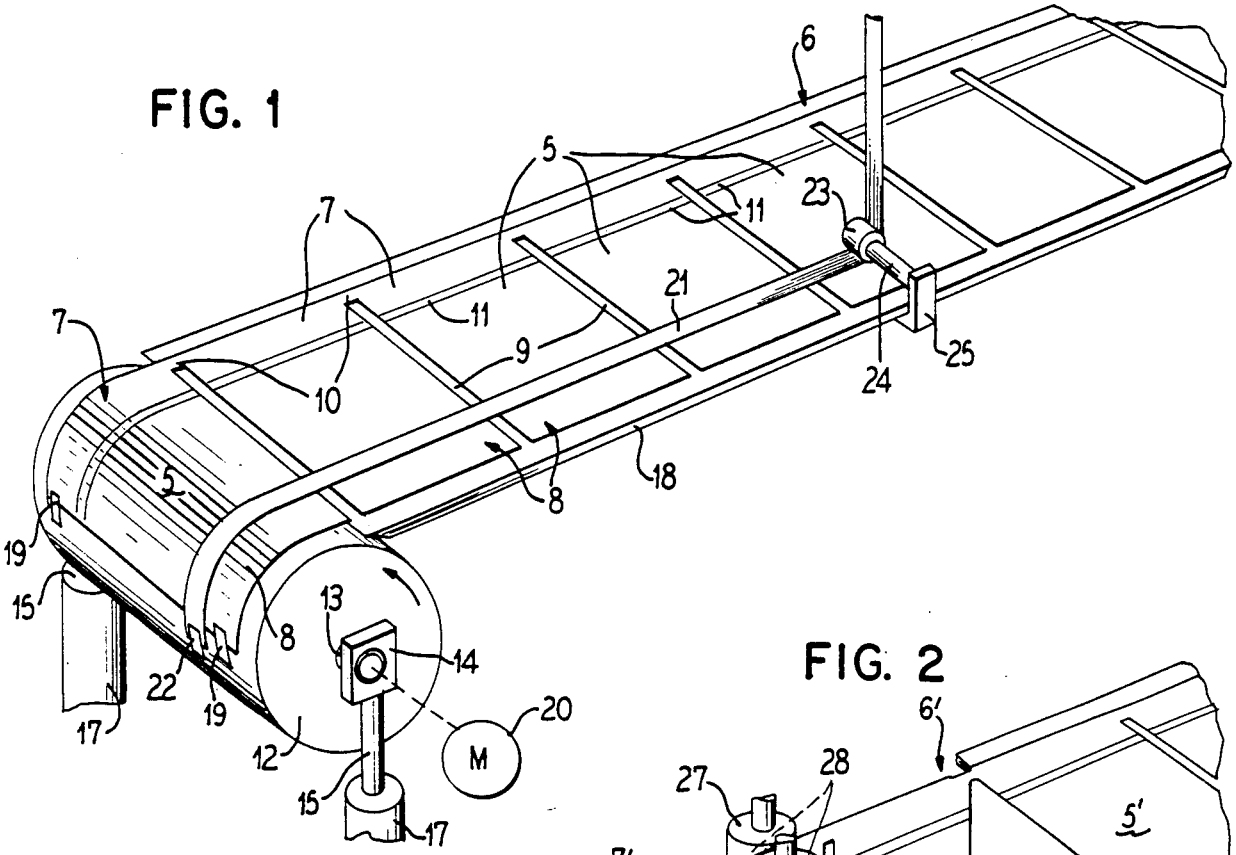
FIG. 1 is a more or less schematic perspective view of a single link bag chain, and illustrative of a method of and means for reeling the bag chain without skewing of the bag units.
Figure 2:
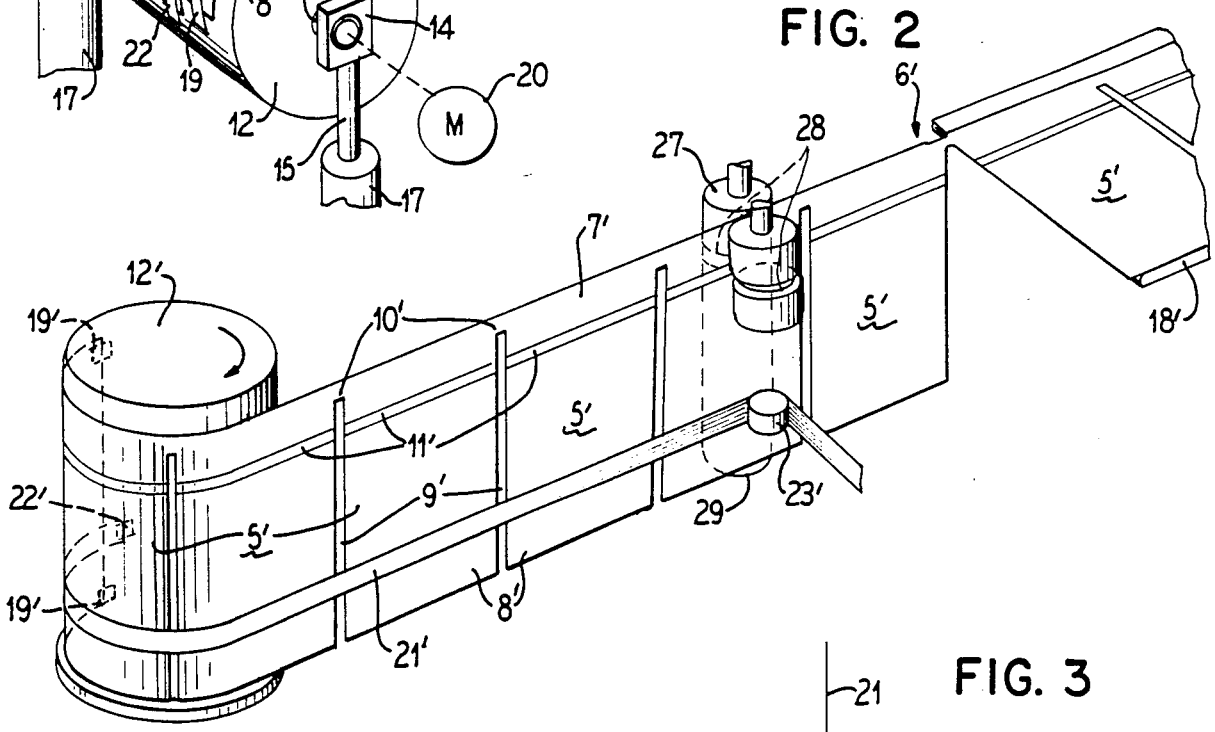
FIG. 2 is a more or less schematic perspective view showing a modification in the method of and means for reeling the chain of bags.
Figure 3:
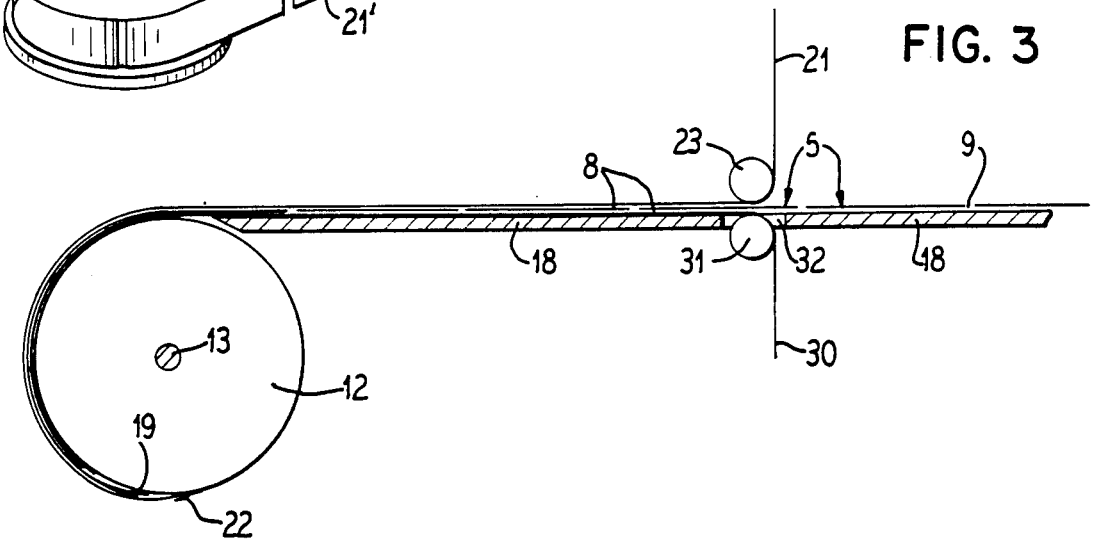
FIG. 3 shows another modification.
Figure 4:
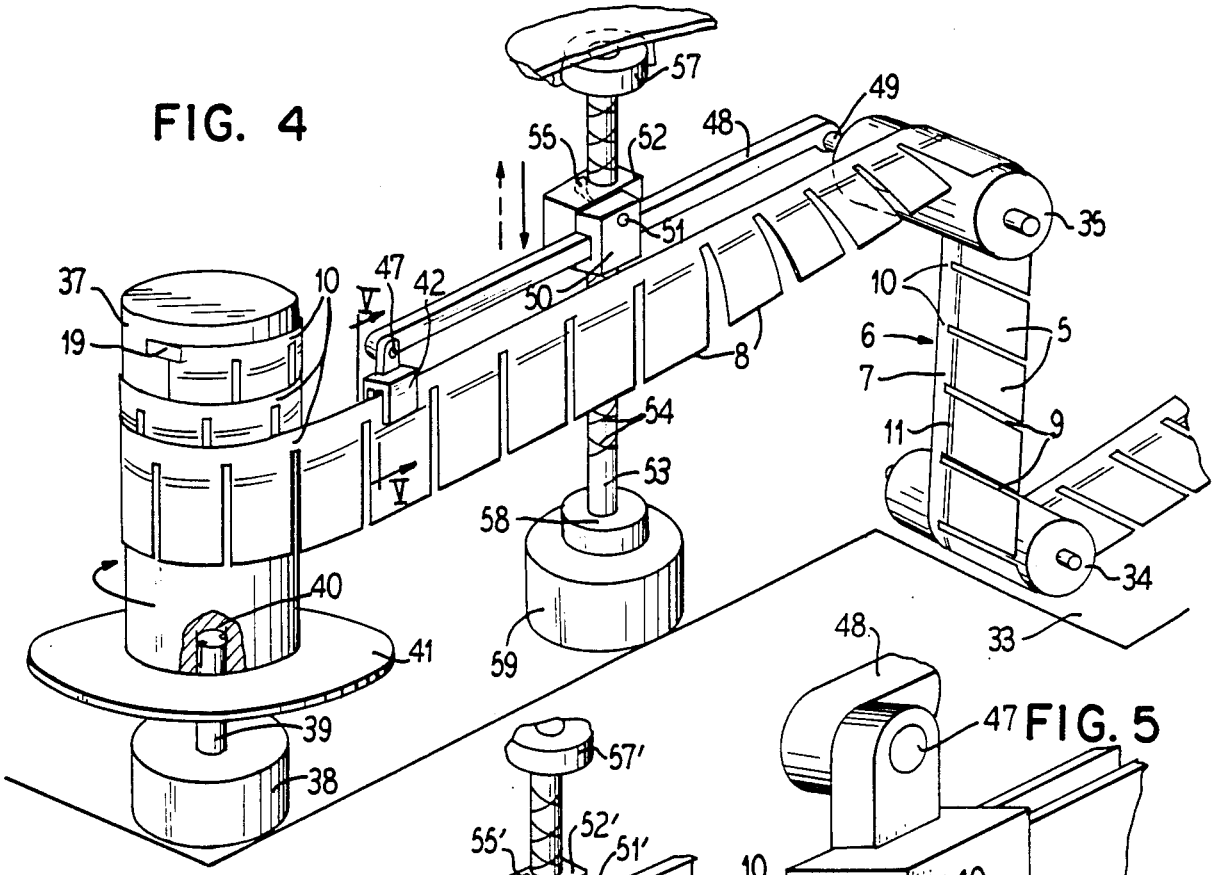
FIG. 4 is a more or less schematic illustration of apparatus for reeling the bag chain in generally spiral fashion upon a core.
Figure 5:
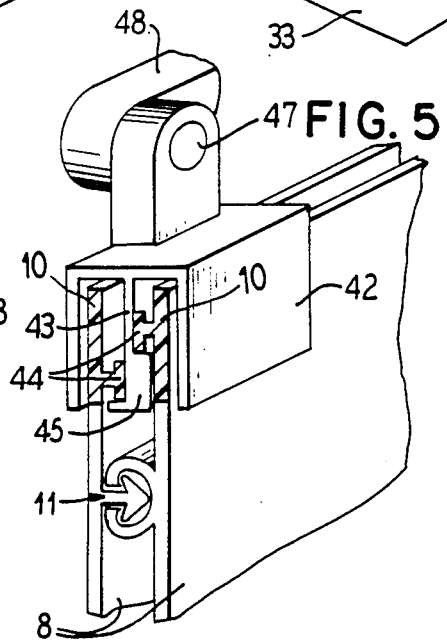
FIG. 5 is an enlarged fragmentary perspective view taken substantially along the line V—V in FIG. 4.

As shown in all of FIGS. 1, 2 and 3, each of a series of bags 5 in a chain 6 has a first end portion 7, i.e. top, and a second end portion 8, i.e. bottom. Each bag is separated from each adjacent bag by a separating slit or slot 9 except at single links 10 connecting the first end portions 7 of the bags into a continuous series. The bags 5 may be generally of the type disclosed in the aforesaid U.S. Pat. Nos. 4,416,376 and 4,514,962, and the present invention would be useful in the handling of the single link bags shown in those patents wherein the links connecting the bags are aligned with separable and reclosable fastener means corresponding to fastener means 11 herein. In the present instance, however, the slots 9 extend through and completely separate the fastener means 11 of each bag from each other bag and the connecting links 10 are at the upper extremities of the slots at the first end portions 7 and in line with the upper ends of the bags 5 when finished; generally as disclosed in copending application of Lems, Ausnit and Nocek, Ser. No. 746,079, filed June 18, 1985 and assigned to the same assignee.

A problem solved by the present invention is the maintaining of the chain bags 5 substantially free from skewing relative to one another when prepared for storage and handling, and especially when wound into a roll on a reel core 12 (FIG. 1). The core 12 is rotatably mounted by means of a generally horizontal shaft means 13 on bearing means 14 at both ends. The bearing means 14 is supported by vertical pillar or shaft means 15 which desirably comprise vertically adjustable piston rods of fluid actuators such as hydraulic cylinders 17, so that the reel core 12 may be vertically adjusted as a whole, or relatively at either or both ends selectively and progressively relative to the level of a table 18 on which the chain of bags 5 is fed to the reel core 12.

At the lead or starting end of the chain of bags, the first bag 5 in the chain is attached to the reel core 12 as by means of clips 19, one of the clips gripping the first end portion 7 of the bag and another of the clips gripping the second end portion 8 of the bag. Thereby, upon rotation of the reel core 12 counter-clockwise, as shown, as by being driven by a motor 20, the chain of bags 5 will be drawn along the table 18 by means of the continuous link connection 10 and the bag chain wound upon the reel 12.

In a means for maintaining the bags 5 substantially free from skewing relative to one another, a continuous strip 21 has been provided for separably engaging across the second end portions 8 of the chain bags 5. Although the strip 21 may comprise string or thread or other strand material, a desirable form comprises thin, inexpensive paper tape or ribbon. In applying the strip 21 to the bag chain, the strip is fed from a suitable source (not shown) such as a supply roll and is attached as by means of a clip 22 to the reel core 12 adjacent to the clip 19 which engages and attaches the second end portion 8 of the lead bag 5 to the core 12.

From the supply source, the strip 21 is trained to run under a freely rotating guide roller 23 mounted on a horizontal shaft 24 overlying the table 18 transversely and in suitable spaced relation and carried by a bracket 25 mounted at the side of the table 18 on which the second end portions 8 of the bags 5 travel along the table toward the reel 12. The relationship of the guide roller 23 to the table and the bags 5 travelling along the table under the tape or ribbon 21 is such that the bags 5 may be lightly contacted to maintain them flat without putting any such pressure on the bags as would tend to cause the bags to be frictionally restrained while travelling along the table 18. Then as the bags 5 reach and are wound on the reel 12, the strip 21 firmly holds each successive bag onto the reel core 12. As the bag chain winds onto the reel core 12, the bags in the chain are held against skewing by the strip 21, and the chain will wind firmly upon itself. A more than partially wound condition of the bag chain is not specifically shown because a fully wound storage roll is self-evident from the disclosure. As the bag chain winds onto the reel core 12, the overall diameter will increase, and in order to maintain the on-running portion of the perimeter of the storage roll of bags on the reel core 12 at substantially the height of the table 18, the reel core 12 may be progressively lowered by the supporting actuators 17, to compensate for the increasing diameter.

In a modified mode of winding the bag chain 6' on a vertical reel core 12' (FIG. 2) the bag chain may be fed from source to a table 18' and then drawn off of the trailing end of the table by rotation of the reel core 12' to which the lead bag 5' is attached and advanced, in the same manner as described in connection with the attachment and advancement to the reel core 12 in FIG. 1. As the horizontally lying bags 5' leave the trailing end of the table 18', they drop into a generally vertical position, that is, with the first or top end portions 7' at the top and the second or bottom end portions 8' in depending relation, so as to be parallel to the perimeter of the vertical reel core 12'. To avoid sagging of the bag chain 6' between the end of the table 18' and the reel 12', supporting means such as vertical axis idler rotary pinch rolls 27 may be provided which engage the upper end portions 7' of the bags and may have clearance grooves 28 through which the fasteners 11' run and which actually may track with the fasteners 11' to assist in supporting the bag chain. The anti-skewing strip means tape 21' is fed from a suitable source and trained about a free running vertical axis guide roller 23' into generally nipping relation to a downward extension 29 of the roller 27 which is located on the opposite side of the bag chain from the guide roller 23'. Downstream from the guide roller 23', the tape 21' follows the bags 5' to the reel core 12' where the tape firmly winds onto and holds the bags in the chain onto the core 12'.

If for any reason it is desired to provide a dual strip engagement of the bags 5 for winding onto the reel core 12, the arrangement shown in FIG. 3 may be employed. For this purpose, the arrangement may be similar to that in FIG. 1, except that in addition to the anti-skew tape 21, a second anti-skew tape 30 is provided for engagement with the opposite side of the bags 5 from that toward which the tape 21 or 21' is directed, that is the tape 30 is directed to engage the underside of the second end portions 8 of the bags 5 in sandwiched cooperation with the tape 21, as shown. The tape 30 is fed from a suitable source, such as a conventional roll, over an idler roller 31 which may be accommodated in an opening 32 in the table 18, under the idler guide roller 23. At its leading end, the tape 30 is adapted to be anchored to the reel core 12 by means of the clip 22 similarly as the clip anchors the tape 21. That is, the same clip may jointly engage and anchor the leading end of the tapes 21 and 30 to the reel core 12.

When the roll of chain bags 5 is fed to a filling device such as a filling machine from the reel core 12 or 12', as the case may be, the tape 21 or 21', as well as the tape 30 where that is also used, may either be wound up from the bag chain as the tape is unwound from the storage reel, or the tape may just be permitted to drop off into a waste receptacle from the bag chain as the assembly is unwound from the reel core.

As disclosed in FIGS. 4–7, there is provided means for supporting the continuous bag chain reeled upon itself and the bags maintained substantially free from skewing relative to one another, without the use of skew-preventing tapes. Another advantage of this arrangement is that a greater footage or length of the bag chain can be received on and conveniently handled in a single reel. To this end, the bag chain 6 (FIG. 4) may travel from bag making apparatus (not shown) across a table 33 to a rotatable guide roller 34 which may or may not be rotatably driven, depending upon particular circumstances such as bag link strength, speed of operation, etc. From the guide roller 34, the bag chain is directed generally upwardly and runs over a rotary guide roller 35 and from there is directed in a generally horizontal direction toward a vertical reel core 37. In so directing the bag chain 6, the upper end portions 7 of the bags are at the top and the bottom end portions 8 depend in vertical direction. The leading end of the bag chain is desirably anchored in suitable manner to the core 37 as by means of the clip 19, similarly as in FIG. 1, adjacent to the top end of the core. Suitable drive means, such as a motor or the like 38, drives a vertical drive shaft 39 suitably keyed into a coupling socket 40 in the lower end of the reel core 37 which may have a lower end flange 41. If preferred, the flange 41 may be a turntable on which the lower end of the core 37 rests removably.

Means are provided for guiding the bag chain 6 onto the reel core 37 in a generally spiral fashion so that the bag chain is spirally wound upon itself. In one manner of effecting spiral guidance, a guide head 42 (FIGS. 4 and 5) guidingly engages the continuous bag link upper extremity portion of the bag chain. For this purpose, the guide head 42 may be of generally inverted "U" shape structure and provided with a flange septum 43 extending down between guide ribs 44 projecting toward the septum from the continuous lips along the link area 10 of the chain. Guide track means 45 on the septum 43 underlying the ribs 44 provides guidance support for the bag chain. For spirally guiding the bag chain 6, means are provided for oscilatably moving the guide head 42 up and down coordinated with the speed of rotation of the reel core 37. In one desirable arrangement, the guide head 42 is pivotally attached as at 47 to the distal end of a rocker arm 48 which is pivotally mounted at its proximal end on a shaft 49 which may be an extension of a shaft on which the guide roller 35 is mounted.

For vertically oscillating the rocker arm 48, the arm projects slidably through a guide block 50, which is mounted as by means of a pivot 51 to a follower block 52 on a vertical conventional spooler screw 53 which has the customary reverse spiral flutes 54 in which a lug 55 on the follower block 52 engages. At its upper end the screw 53 may be rotatably supported in a bearing 57, and at its lower end the screw may be supported in a thrust bearing 58 and driven rotatably as by means of a motor 59. As the screw 53 is driven continuously rotatably in one direction, the follower block 52 is caused to successively run up and down the screw, thereby correspondingly rocking the arm 48 and causing the guide head 42 to guide the bag chain 6 to wind spirally upon itself on the rotatably driven core 37. Thereby the bag chain 6 as it winds upon itself not only provides a spirally wound roll 60 (FIG. 7) but the successive outer loops of the bag chain winding upon the inner loops hold the bags against skewing. The fully wound roll on the loaded core 37 may be wrapped for convenient handling without skewing the bags in the outermost wrap of the bag chain.

Figure 6:
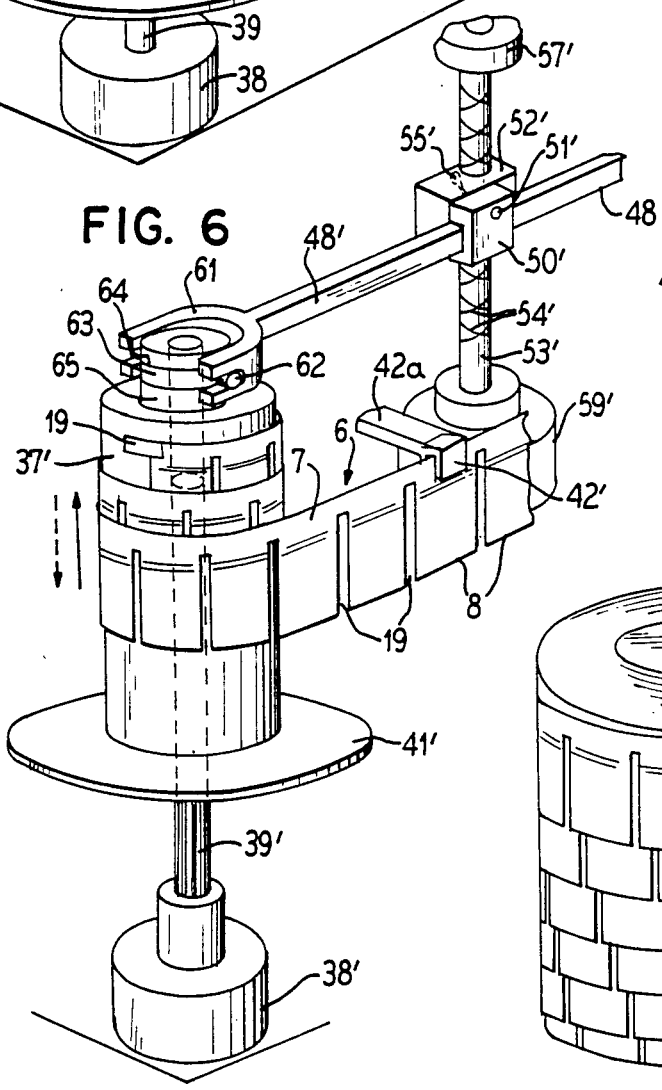
FIG. 6 is a more or less schematic fragmentary perspective view showing a modification in the means for reeling the chain.
Figure 7:
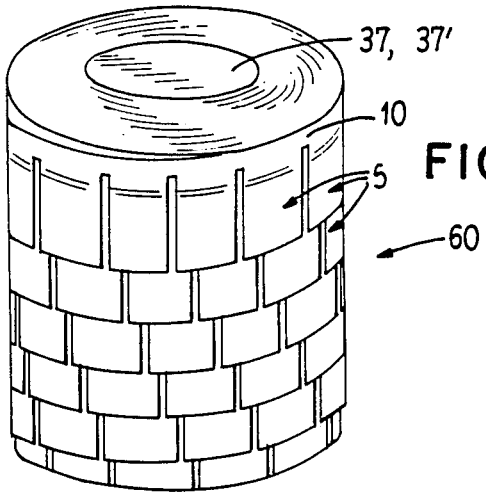
FIG. 7 is a perspective view of a spirally wound storage roll of the single link bag chain.

Instead of the bag chain being oscillatably guided for spiral winding along the reel core, the arrangement shown in FIG. 6 may be employed wherein the core 37' is vertically reciprocated to attain the spiral winding of the bag chain 6 on the core. For this purpose, the drive shaft 39' is elongated and may be splined, and projects to a sufficient length to permit the core 37', provided with a complementary elongated axial keying bore or socket, to slide vertically on and be driven rotatably by the rotating drive shaft. For effecting the vertical oscillations, means such as a slotted arm yoke device 61 on an extension 48'' of the rocker arm 48' engages with trunions 62 on a coupling ring device 63 running in a groove 64 in an upper end boss 65 on the core 37'. Therefore, as the core 37' is rotated, the oscillating yoke 61, moved by mechanism similar to the mechanism described in connection with FIG. 4 and identified by similar primed reference numerals, causes the core to correspondingly oscillate vertically and the bag chain 6 is spirally wound into the roll 60. The bag chain 6 is supported in a vertical position by the guide head 42' which in this instance is supported by a stationary arm **42*a***.

It will be understood that variations and modifications may be effected without departing from the spirit and scope of the novel concepts of the present invention.

I claim as my invention:

1. In combination with a series of bags having first and second end portions and separated from one another except at single link means connecting the first end portions of the bags and thereby joining the bags into a continuous bag chain wherein said second end portions of the bags are entirely separated from one another:

means supporting the bag chain reeled upon itself into a storage roll;

and means engaging against one face of said second end portions for maintaining the bags in the reeled chain substantially free from skewing relative to one another.

2. A combination according to claim 1, wherein said means for maintaining free from skewing comprises a continuous strip separably engaging across the second end portions of the bags in the chain, said strip retaining the second end portions of the bags firmly against skewing.

3. A combination according to claim 2, wherein said strip comprises a ribbon tape.

4. A combination according to claim 2, wherein a second continuous strip separably engages across an opposite face of said second end portions in cooperation with said first mentioned strip.

5. A combination as defined in claim 1, including a core and the bag chain is spirally wound upon itself on the core.

6. A combination according to claim 1, including retaining means on a reel core attaching the bag chain to the reel core.

7. A method of maintaining free from skewing a series of bags having first and second end portions and separated from one another except at single link means connecting the first end portions of the bags and thereby joining the bags into a continuous bag chain wherein said second end portions of the bags are entirely separated from one another, comprising:

reeling the bag chain upon itself into a storage roll;

and engaging against one face of said second end portion means for maintaining the bags in the reeled chain substantially free from skewing relative to one another.

8. A method according to claim 7, comprising spirally winding the bag chain upon itself on a core.

9. A method according to claim 7, comprising attaching the bag chain to a reel core by retaining means on the reel core.

10. A method according to claim 7, comprising supporting said bag chain with said second end portions depending from said first end portions during said reeling.

11. A method according to claim 7, which comprises separably engaging a continuous strip across faces of the second end portions of the bags in the chain and thereby retaining the bag chain firmly in the storage roll.

12. A method according to claim 11, comprising suplying said strip as a ribbon tape.

13. A method according to claim 11, comprising engaging said continuous strip across one of the faces of said second end portions of the bags in the chain, and separably engaging a second continuous strip across the opposite faces of the second end portions in cooperation with said first mentioned continuous strip.

14. Apparatus for handling a series of bags having first and second end portions and the bags being separated from one another except for single links connecting the first end portions of the bags and thereby forming the bags into a continuous bag chain wherein said second end portions of the bags are entirely separated from one another, comprising:

means for rotatably supporting a reel core for reeling the bag chain upon itself on the core;

means for rotatably driving said reel core; and anti-skewing means for engaging against one face of said second end portions and maintaining the bags substantially free from skewing relative to one another as the bag chain is wound on the core.

15. Apparatus according to claim 14, wherein said anti-skewing means comprises a tape, and a guide for guiding said tape into engagement with the bags of the chain.

16. Apparatus according to claim 14, comprising rotatable support for said core, and a guide for guiding the bag chain onto the core in spiral fashion so that the bag chain winds upon itself and serves as the anti-skewing means by retaining the second end portions of the bags against skewing.

17. Apparatus according to claim 14, including means for vertically oscillating said reel core and thereby effecting spiral winding of the bag chain as the reel core rotates.

18. Apparatus according to claim 14, comprising oscillating arm means for guiding said bag chain onto the reel core in spiral fashion to wind upon itself.

19. Apparatus according to claim 14, including means for separably engaging a continuous strip across the second end portions of the bags in the chain for maintaining the bags substantially free from skewing relative to one another.

20. Apparatus according to claim 19, comprising means for engaging a second continuous strip separably with the faces of said second end portions which are opposite to the first mentioned strip and said second strip cooperating with said first mentioned strip for maintaining said bags against skewing.

21. Apparatus according to claim 14, comprising a guide head for guiding said bag chain to the reel core, and comprising a track on said head for engaging with guide ribs on said links on said first end portions of the bags in the continuous chain.

22. Apparatus according to claim 14, comprising means for supporting said chain in generally horizontally disposed relation.

23. Apparatus according to claim 14, which comprises means for supporting said bag chain in a generally vertical disposition of the bags, with the second end portions of the bags hanging downwardly from the first end portions.

* * * * *